US005993287A

United States Patent [19]

Melashenko et al.

[11] Patent Number: 5,993,287

[45] Date of Patent: Nov. 30, 1999

[54] CHILDREN'S PLAY STRUCTURE

[75] Inventors: Robert A. Melashenko; Connie R. Melashenko, both of Loma Linda, Calif.

[73] Assignee: Calapitter Creations, Inc., Redlands, Calif.

[21] Appl. No.: 08/732,189

[22] Filed: Oct. 17, 1996

[51] Int. Cl.[6] ..... A63H 3/52

[52] U.S. Cl. ..... 446/478; 160/135; 52/238.1

[58] Field of Search ..... 446/478, 476, 446/479; 160/135, 351; 52/238.1, 239; 403/329

[56] References Cited

U.S. PATENT DOCUMENTS

| | | | |
|---|---|---|---|
| 3,247,628 | 4/1966 | Miller | 160/135 X |
| 3,571,999 | 3/1971 | Downing | 52/483 |
| 3,709,237 | 1/1973 | Smith | 160/135 X |
| 3,913,598 | 10/1975 | Clutting, Jr. et al. | 160/135 X |
| 4,001,987 | 1/1977 | Coulthard | 52/239 X |
| 4,373,570 | 2/1983 | Nussdorf et al. | 160/351 X |
| 4,516,620 | 5/1985 | Mulhern | 160/351 |
| 4,645,183 | 2/1987 | Rattray et al. | 256/25 |
| 4,669,138 | 6/1987 | Kassai | 256/25 X |
| 4,712,773 | 12/1987 | Larson | 256/25 |
| 4,798,019 | 1/1989 | Sury et al. | 43/1 |
| 4,842,035 | 6/1989 | Thompson | 160/135 |
| 4,884,988 | 12/1989 | McMurray | 446/478 X |
| 4,992,068 | 2/1991 | Conrad | 446/478 X |
| 5,069,623 | 12/1991 | Peat | 434/260 |
| 5,070,665 | 12/1991 | Marrin et al. | 52/239 |
| 5,352,149 | 10/1994 | Melashenko et al. | 446/478 |
| 5,379,786 | 1/1995 | Lynam | 160/135 X |
| 5,382,111 | 1/1995 | Melashenko et al. | 403/329 |

*Primary Examiner*—Kien T. Nguyen
*Attorney, Agent, or Firm*—Fish & Richardson, P.C., P.A.

[57] ABSTRACT

A children's play structure includes a frame having hinging structures capable of being arranged into a free-standing structure and at least one interchangeable panel capable of removable attachment to the frame. The frame is easily assembled and is foldable into a compact structure when not in use. In another embodiment, a children's play structure comprises a unitary piece of relatively rigid, resilient plastic that has been scored in a generally vertical direction to create joints which form foldable frame sections. Interchangeable panels may be attached thereto by means of complementary pairs of hook and loop fasteners attached to the panels and to the frame sections. Alternatively, panels may be removably attached thereto by means of closed loop fasteners such as "O" rings. Such structures are stackable to form a multi-level play structure.

5 Claims, 10 Drawing Sheets

52
54
56
60
61
62
64
65
66
67
68
69
70
70a
74
74a
90

CHILDREN'S PLAY STRUCTURE

BACKGROUND OF THE INVENTION

1. Field of the Invention

The present invention relates to children's play structures, and more particularly to play structures designed to provide the child with a particular theme or environment through the use of various scenes, murals or the like.

2. History of the Prior Art

It is known to provide a child's play structure such as a playhouse or similar free-standing structure to enhance the child's play. Such structures are often provided with scenes, murals or the like which impart a particular theme or environment such as a school classroom, a doctor's office, a store, a spaceship or the like. The scenes or murals depict enough to suggest the desired theme or environment, while at the same time allowing the child to use his or her imagination with respect to some of the details. The child is thus able to act our various activities and sequences of events using the play structure as a prop.

Examples of children's play structures of this type are provided by U.S. Pat. No. 984,735 of Bailey, U.S. Pat. No. 4,919,982 of Hayes, U.S. Pat. No. 4,765,006 of Jackson, et al., U.S. Pat. No. 4,407,494 of Hummel, U.S. Pat. No. 1,881,356 of Gold, U.S. Pat. No. 3,548,552 of McBride, U.S. Pat. No. 2,837,777 of White, U.S. Pat. No. 2,608,726 of Olson, U.S. Pat. No. 1,982,433 of Hungerford, U.S. Pat. No. 1,647,733 of Keichline, U.S. Pat. No. Des. 159,019 of Valentine, U.S. Pat. No. 4,884,988 of McMurray, U.S. Pat. No. 4,696,652 of Reeder, et al. and U.S. Pat. No. 4,556,391 of Tardivel, et al. Such play structures are often made in a foldable or collapsible configuration so that they can be folded or otherwise substantially reduced in size to facilitate storage thereof when not in use. Such structures are assembled or erected to form a free-standing structure of use. As shown in some of the patents noted above, the play structures may form an enclosure to simulate a room or a house, and can be provided with partitions or other interior members which divide the interior into plural rooms, compartments or the like. Still other structures, such as the considerably smaller playhouse for use with paper dolls shown in the Hungerford patent noted above, provide different partitions or additions to change portions of the structure somewhere.

While conventional children's play structures such as those described in the patents noted above provide a variety of different forms, themes, ideas and features, such structures are somewhat limited when it comes to their ability to easily convert to different themes or environments. Most such structures, for example, are designed to provide one and only one theme or environment with no interchange ability being possible. Still others provide for some interchange ability, but typically at the expense of complexity and an inherent difficulty in making the changes.

Accordingly, it is an object of the present invention to provide a children's play structure of relatively simple, low-cost construction which is easily folded or disassembled for storage, and which has multiple scenes or murals which are easily replaced to change the theme or environment of the structure.

SUMMARY OF THE INVENTION

Children's play structures according to the invention utilize one or more interchangeable panels in conjunction with a frame. Each panel is comprised of a scene or mural or portion thereof representing a particular theme or environment. The interchangeable panels are easily installed on and removed from the frame so as to change the theme or environment of the play structure. The frame, which is erected to form a free-standing structure when in use, is foldable into a compact structure to facilitate transportation and storage.

In one embodiment, a children's play structure may utilize a frame comprised of a sheet of a generally planar, solid, resilient material having opposite broad surfaces, such as corrugated high density polyethylene or similar material, joined at scores incised partially through the sheeting on at least surfaces in a generally vertical direction to form a foldable or bendable joint and thereby forming a plurality of frame sections. Each frame section is connected to at least one other frame section by a joint. If desired, the sheeting material may be incised at corresponding positions on opposite surfaces. The frame forms a generally enclosed free-standing structure when erected for use.

Such a play structure also comprises a plurality of interchangeable multi-panel members. The members are easily installed on the frame to provide the frame with a plurality of panels depicting various scenes or murals which impart a desired theme or environment of the play structure. Each member has opposite sides disposed against the opposite broad surfaces of the hinging sections of the frame when installed on the frame. Each hinging section of the frame is thereby provided with a panel having a particular scene or mural or portion thereof thereon. The scenes or murals are painted or printed on one or both of the opposite sides of the member. The member is preferably comprised of flexible material such as a length of canvas, cloth, or thin plastic sheeting. To assist in holding the member in place on the frame, the side of the member that is to be secured to the frame is provided with fastening members, for example, hook and loop fasteners sold under the trademark Velcro. Panels are removably attached thereto by appropriate fasteners such as small Velcro patches mounted on the frame and secured to the back side of mating portions of the panel. Panels are easily removed from the various sections of the frame by simply pulling the panel away from the frame to separate the Velcro patches. A replacement panel containing a different desired scene or mural or portion thereof and which is provided with Velcro patches at the back side thereof is then easily installed over the hinging section of the frame by attaching the Velcro patches thereof to the Velcro patches mounted on the frame.

In another embodiment according to the invention, a children's play structure comprises a plurality of hinging structures, including at least first and second hinging structures. Each such hinging structure comprises a vertical rod having upper and lower studs extending from opposite ends of the rod, each stud having a polygonal portion and a cylindrical portion of narrower width distal to the polygonal portion. Each hinging structure further comprises a pair of first and second end posts removably attached to the upper stud and a pair of first and second end posts removably attached to the lower stud. The end posts have a lug with a polygonal aperture offset from the longitudinal axis of a nose portion of the end posts. The apertures of the first end posts engage or fit over the polygonal portion of the studs so that the first end posts are not able to pivot about the rod. The apertures of the second end posts are disposed about the cylindrical portion of the studs and are able to pivot about the rod, because the cylindrical portions is of a narrower width than the aperture. The hinging structure further comprises a pair of caps removably attached to each of the upper and lower studs of the rod, distal to the second end posts.

Each hinging structure further comprises a plurality of upper and lower frame members, typically at least three pairs. A pair of first upper and lower frame members is secured at one end of the member to either the first or the second end posts of the first hinging structure. The opposite end of the first upper and lower frame members are secured to either the first or the second end posts of the second hinging structure.

A play structure of this embodiment further comprises a second pair of second upper and lower frame members is secured to the other of the end posts of the first hinging structure, i.e., those end post to which the first pair of frame members is not secured.

A play structure of this embodiment further comprises a pair of third upper and lower frame members is secured to the other of the end posts of the second hinging structure, i.e., those end posts to which the first pair of frame members is not secured.

A play structure of this embodiment further comprises first and second terminal hinging structures. Each terminal hinging structure comprises a vertical rod having upper and lower studs extending from opposite ends of the rod, each stud having a polygonal portion and a cylindrical portion of narrower width distal to the polygonal portion. An end post is removably attached to each of the upper and lower studs. The end posts have a lug with a polygonal aperture therein, that are non-pivotably disposed about the polygonal portion of the studs.

The first terminal hinging structure end posts are secured to the second upper and lower frame members and the second terminal hinging structure end posts secured to a pair of upper and lower frame member other than the first and second upper and lower frame members.

The play structure of this embodiment further comprises at least one interchangeable panel member, which is removably attached to the first or the second upper and lower frame members. The play structure of this embodiment further comprises engagement means for removable attachment of the interchangeable panel member to one pair of upper and lower frame members. The panel member typically has a scene or mural or portion thereof painted or printed thereon. Each panel is approximately the same size as the corresponding frame section. The panels are removably attached to the frame by fastening members, e.g., hook and loop fasteners such as Velcro, or closed loop fastening members such as "O" rings.

DESCRIPTION OF THE PREFERRED EMBODIMENTS

Figure 1A:
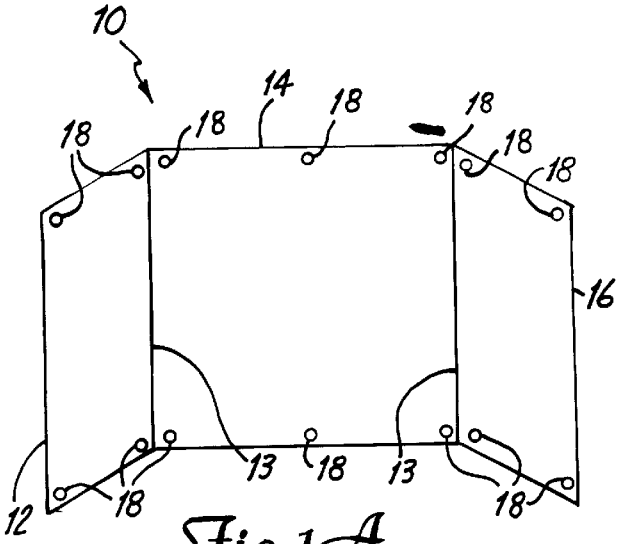
FIG. 1A is a perspective view of a children's play structure in accordance with the invention.

FIG. 1 illustrates a children's play structure 10 according to a first embodiment of the invention. Play structure 10 comprises a plurality of frame sections, shown in FIG. 1 as three sections 12, 14 and 16. Frame sections 12, 14 and 16 are generally planar members and are made of a solid, lightweight, durable, resilient material, for example, plasticized cardboard. In the embodiment shown in FIG. 1A, sections 12, 14 and 16 are prepared from a single sheet of corrugated high density polyethylene having a nominal thickness of about 4 millimeters (mm). Suitable sheets of such material are available from, for example, United States Corrulite Corporation as double-faced laminate sold as Corrulite®.

Frame sections 12, 14 and 16 are separated by vertical scores 13 on at least one side of structure 10. Scores 13 are of sufficient depth to permit sections 12, 14 and 16 to be folded relative to one another, but not so deep as to completely separate each section from the remaining sections. Although not shown in FIG. 1A, sections 12, 14 and 16 may be scored on the opposite side at the positions and in the direction corresponding to scores 13, if desired.

Structure 10 further comprises a plurality of fastening members 18 secured to each of sections 12, 14 and 16. Fastening members 18 typically are one member of a complementary pair of hook and loop fasteners of the type sold under the trade name, Velcro. However, other fasteners having similar properties may be used, as is known in the art.

Structure 10, when erected, may assume a free-standing, generally enclosed configuration as shown in FIG. 1A or may assume a more linear configuration. When not in use, structure 10 may be folded into a compact structure by folding sections 12 and 16 onto section 14 so as to facilitate transportation and storage.

Figure 1B:
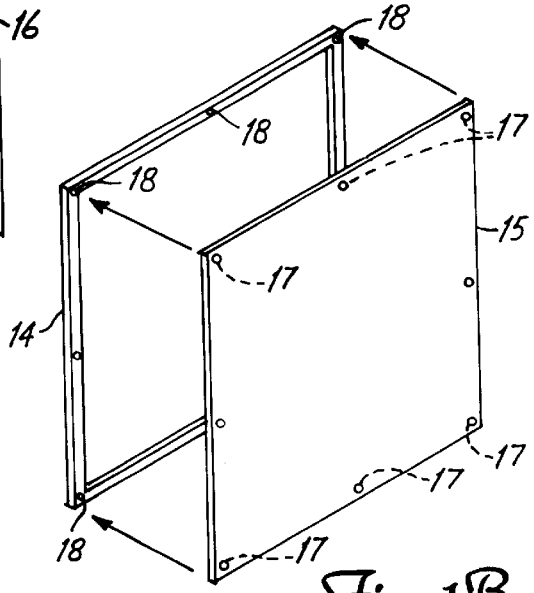
FIG. 1B shows a mating panel of a first embodiment, showing the manner in which the mating panel is removably secured to a section of the frame by hook and loop fasteners.

Sections 12, 14 and 16 of structure 10 are each suitable for receiving a panel 15, as illustrated in FIG. 1B for section 14. Panel 15 comprises a flexible material such as canvas, thin polyethylene sheeting, laminated paper, cloth or similar material and includes a plurality of fastening members 17 secured to the back side of the flexible panel material. Fastening members 17 are secured and aligned on panel 15 at positions suitable for removable attachment to corresponding fastening members 18 on section 14.

Panel 15 typically has a play scene or mural painted or imprinted thereon. When a plurality of panels 15 are used, the scenes or murals on each different panel may combine to form a substantially continuous play scene.

Figure 2B:
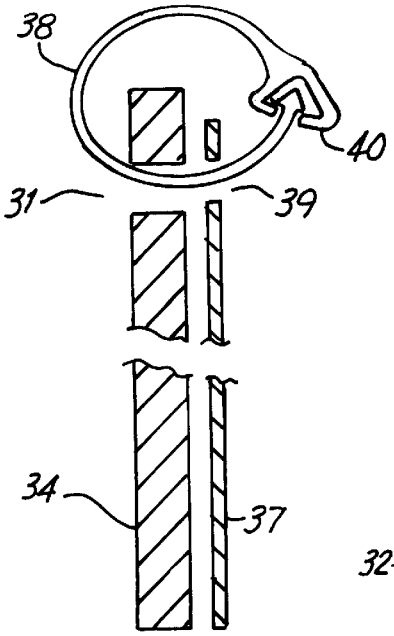
FIG. 2B shows a cross-sectional view along line A—A of FIG. 2A.
Figure 2A:
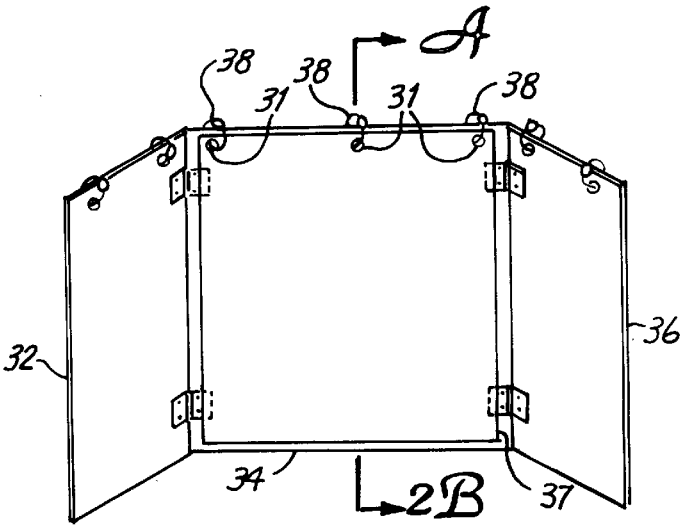
FIG. 2A is a perspective view of a children's play structure of a second embodiment, showing the manner in which a panel is removably secured to the frame by closed loop fastening members.

A second embodiment of the invention is shown in FIG. 2A. Play structure 30 comprises a plurality of hinging sections, shown in FIG. 2A as three sections 32, 34 and 36. Sections 32, 34 and 36 are generally planar members and are each made of a solid, lightweight, durable, resilient material, similar to that described above, e.g., corrugated high density polyethylene having a nominal thickness of about 4 millimeters (mm). Each of sections 32, 34 and 36 is connected to adjacent section or sections by conventional hinges 33.

Frame sections 32, 34 and 36 have at least two apertures or openings 31 positioned near an upper edge. Three such apertures 31 are illustrated in section 34 and two apertures 31 in each of sections 32 and 36. Structure 30 also comprises at least one panel 37 removably attached to a section, as shown in FIG. 2A. Panel 37 is removably attached to section 34 by means of closed loop fastening members 38, which are disposed within and pass through apertures 31 in section 34 and apertures 39 in panel 37 (FIG. 2B). Panels similar to panel 37 may be removably secured to sections 32 and 36 in the same manner as that shown in FIG. 2A for panel 37 and section 34.

FIG. 2B is a cross-sectional view along line A—A of FIG. 2A and illustrates the means by which panel 37 is removably attached to section 34. Closed loop fastening member 38 typically is constructed of plastic or other resilient material and typically has an annular shape, although other shapes may be used if desired. Fastening member 38 comprises a closing means 40, for example, a snap-fit mechanism such as that found on conventional plastic bathroom shower curtains. Fastening member 38 enters and passes through apertures 31 and 39 to attach panel 37 to section 34.

Panel 37 is a generally planar member made of a solid, lightweight, durable, resilient material, similar to that described above, e.g., corrugated high density polyethylene having a nominal thickness of about 4 millimeters (mm). Panel 37 typically has a play scene or mural painted or imprinted thereon. When a plurality of panels 37 are used, the scenes or murals on each different panel may combine to form a substantially continuous play scene.

Structure 30, when erected, can assume a free-standing, generally enclosed configuration as shown in FIG. 2A or may assume a more linear configuration. When not in use, structure 30 may be folded into a compact structure by folding sections 32 and 36 onto section 34 so as to facilitate transportation and storage.

Figure 3A:
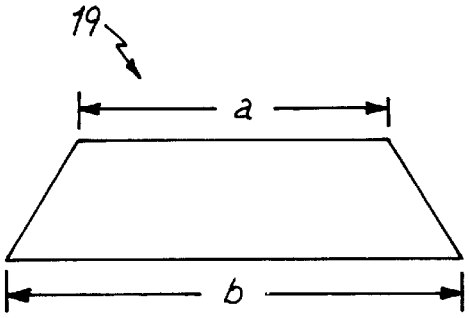
FIG. 3A shows a generally horizontal trapezoidal panel.
Figure 3B:
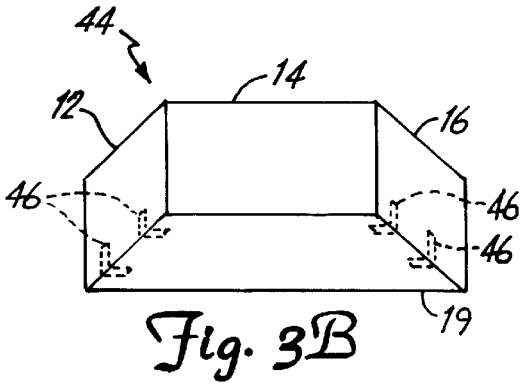
FIG. 3B shows the horizontal trapezoidal panel secured removably to the frame by clip-type fastening members.

Now turning to FIG. 3B, in a third embodiment, play structure 44 comprises a back section 14 and two side sections 12 and 16. In addition, play structure 44 comprises a fourth solid, generally planar horizontal member 19. Horizontal member 19 is made of the same type of material as that used to form sections 12, 14 and. 16. As shown in FIG. 3A, horizontal member 19 has a trapezoidal shape and a rear width "a" that is the same dimension as the width of section 14. Member 19 has a front width "b" that is the same dimension as the front width of structure 10 when structure 10 is erected so that section 12 and 16 form an acute angle relative to back section 14. A plurality of clips 46, of a conventional type, removably attach member 19 to the bottom edges of sections 12, 14 and 16, as shown in FIG. 3B.

Figure 3C:
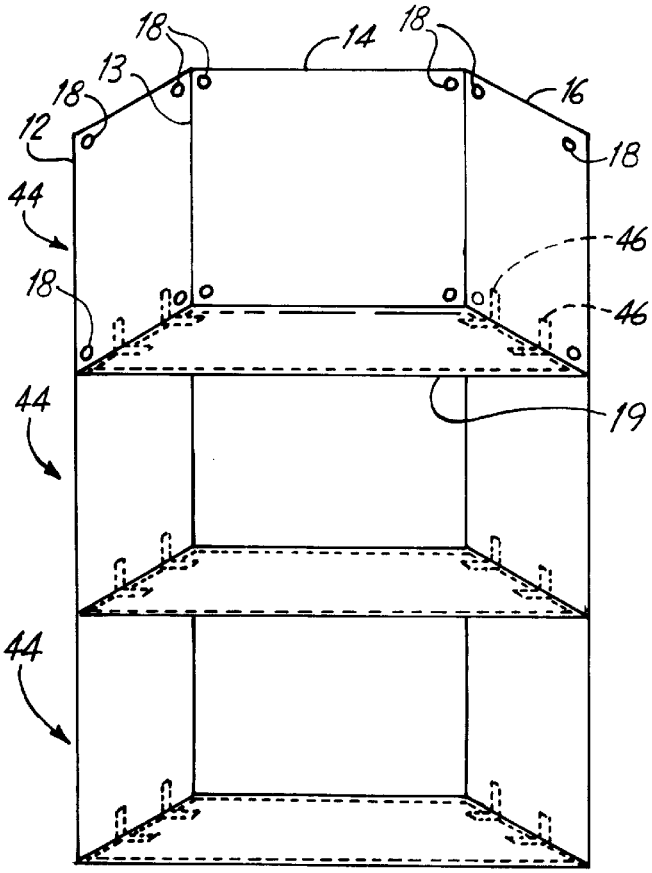
FIG. 3C shows a plurality of play structures in stacked configuration.

A plurality of play structures 44 may be stacked on top of each other to form, for example, a multi-story play house, apartment building or castle, as illustrated in FIG. 3C. Panels similar to panel 15, which have scenes depicted thereon, although not shown in FIGS. 3B or 3C, are removably secured by hook and loop fastening members to sections 12, 14, 16 and even to member 19.

A fourth embodiment is illustrated in FIGS. 4–12. As shown in perspective view in FIG. 4, a children's play structure 50 comprises a plurality of hinging structures 52, a plurality of horizontal frame members 54 and at least one removable panel member 100.

Figures 5A, 5B:
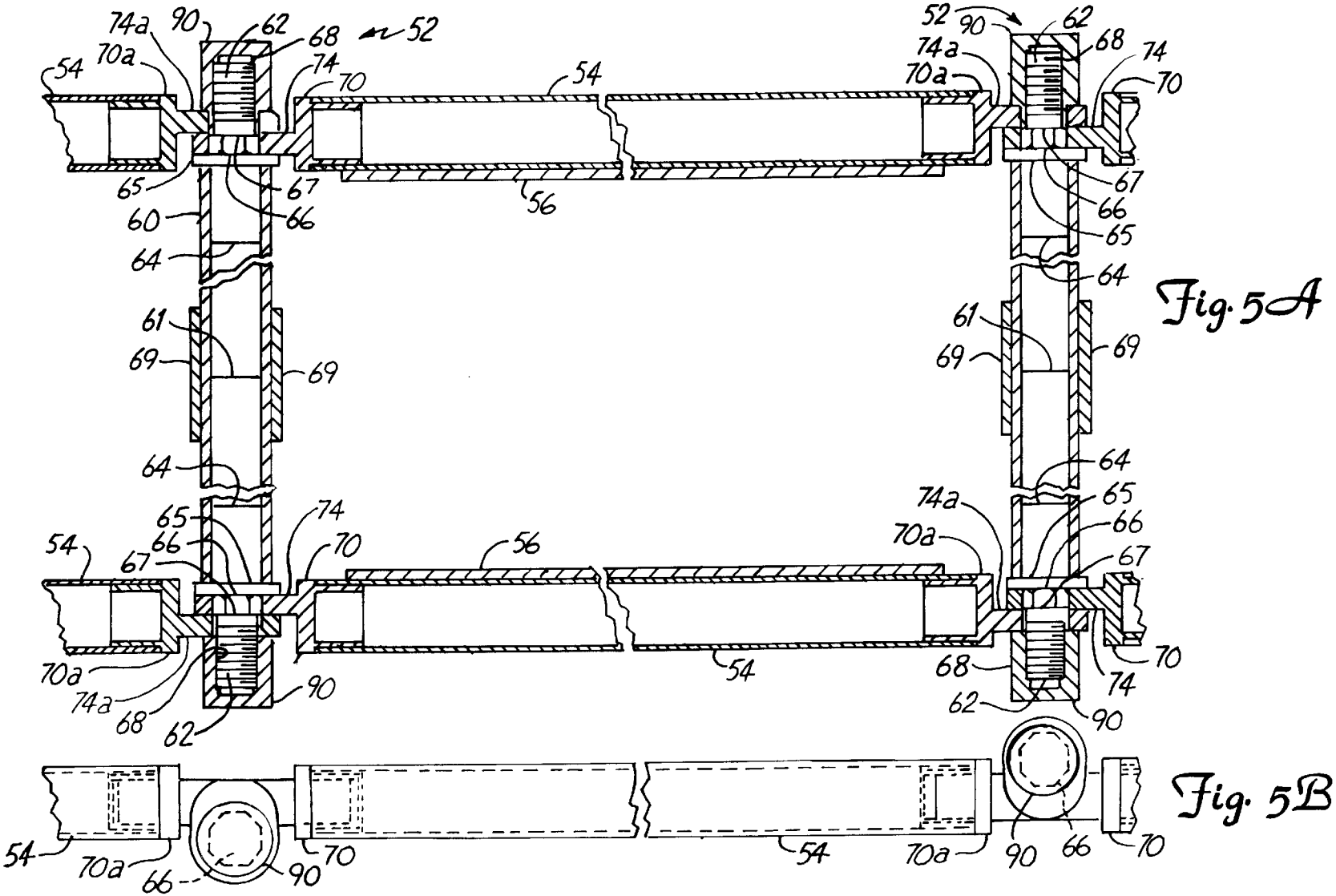
FIG. 5A is an elevational view of a portion of a hinging structure of FIG. 4, opened to assume a linear configuration. A top view of the hinging structure is shown in FIG. 5B.

As shown in cross-sectional view in FIG. 5A, hinge structure 52 comprises a vertical rod 60 having stud portions 62 extending from opposite ends thereof. Rod 60 may be of cylindrical, tubular or beam shape. Rod 60 may be a unitary object or, optionally, may comprise two pieces that are abutted at joint 61 and secured and aligned by gluing collar 69 thereto.

Figure 6:
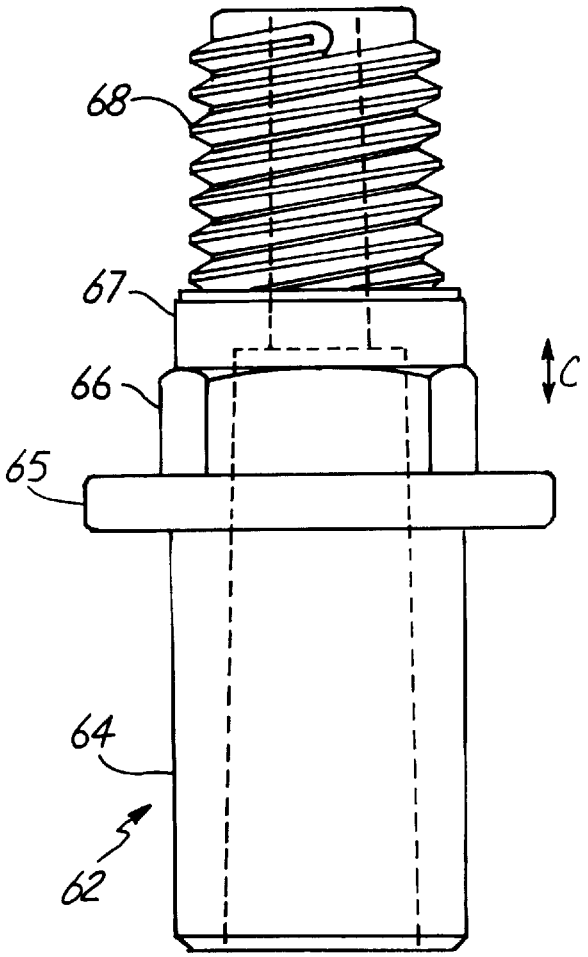
FIG. 6 is a sectional view of a stud of the play structure of FIG. 4.
Figure 9:
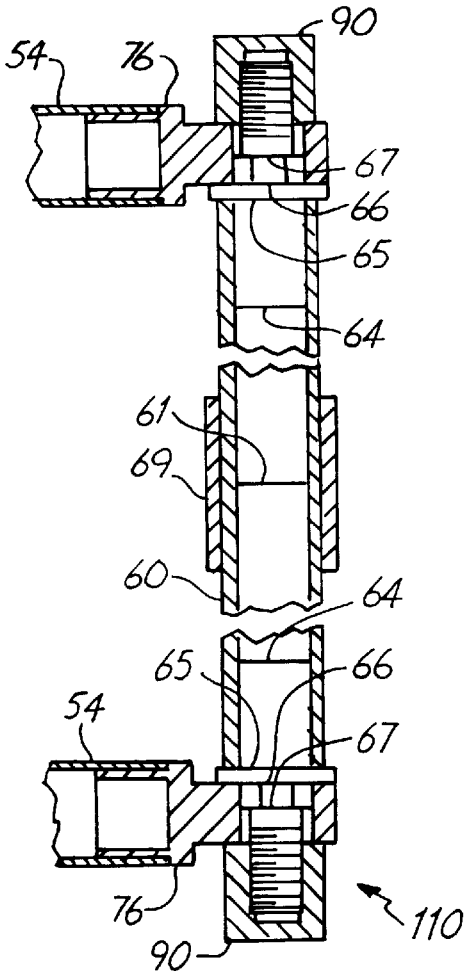
FIG. 9 is a sectional view of a terminal hinging structure of the play structure of FIG. 4.

As shown in FIG. 6, stud 62 comprises a nose portion 64, annular stop ring 65, a polygonal end post retainer portion 66, a cylindrical end post pivoting portion 67 distal to the polygonal portion 66 and cap retainer means 68 at the terminal end of stud 62. Polygonal portion 66 typically has from 3 to 9 sides, preferably from 6 to 8 sides. Cap retainer means 68 is shown in FIG. 6 as threads cut into the side walls of the terminal end of stud 62.

Figures 7A, 7B:
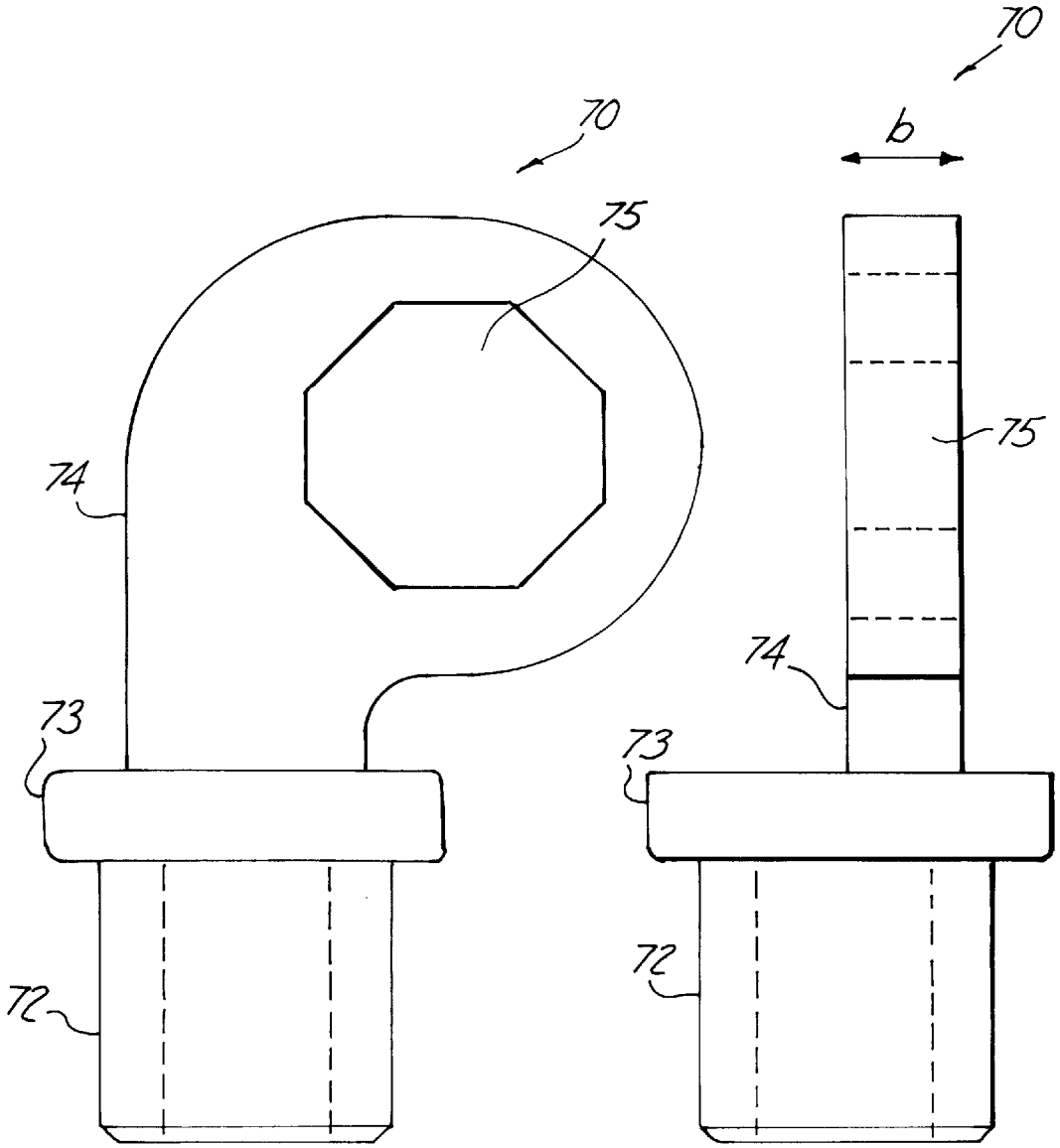
FIG. 7A is a top view of an end post of the play structure of FIG. 4.
FIG. 7B is a side view of an end post of the play structure of FIG. 4.
Figure 8B:
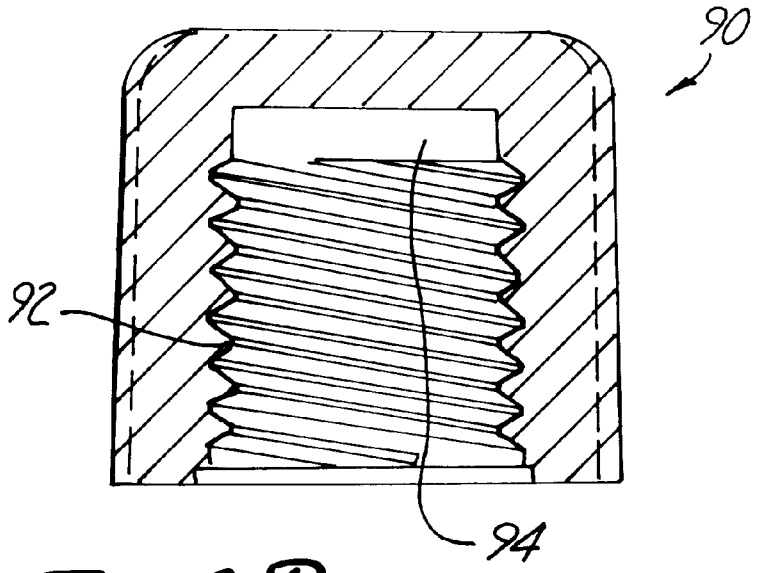
FIG. 8B shows a sectional view of a cap of the play structure of FIG. 4.
Figure 8A:
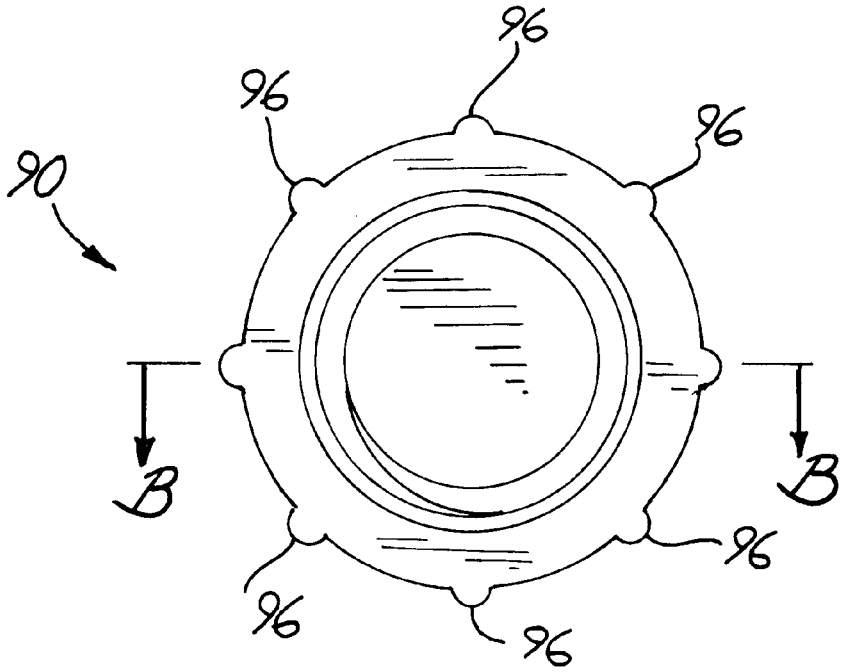
FIG. 8A shows a top view of a cap of the play structure of FIG. 4.

Referring to FIG. 5, two end posts 70 and 70A, of identical construction, are disposed about and extend horizontally from the upper stud 62. Similarly, two end posts 70 and 70*a* are disposed about and extend horizontally from lower stud 62. As seen in FIG. 7A, end post 70 comprises a nose portion 72, stop portion 73 and lug 74. Lug 74 includes a polygonal or non-circular aperture 75, which has the same number of polygonal sides as that present on retainer 66 and is of a size suitable to engage corresponding polygonal sides of retainer 66.

Referring to FIG. 5A, lug 74 of upper end posts 70 rests against stop ring 65. Aperture 75 of upper end post 70 is seated on polygonal retainer portion 66 of stud 62 so that polygonal sides of retainer 66 are aligned with and engage corresponding polygonal sides of aperture 75. Width "b" of lug 74 (FIG. 7B) is slightly greater than width "c" of retainer portion 66 (FIG. 6), so that only aperture 75 of end post 70 can engage polygonal portion 66. Engagement of the polygonal sides of aperture 75 and retainer 66 places end post 70 in fixed, non-pivotable relationship with vertical rod 60.

Lug 74A of upper end post 70*a* is connected to stud 62 distal to end post 70, resting on lug 74 of end post 70 and retained on stud 62 by cap 90. Aperture 75 of upper end post 70*a* is disposed about portion 67 of stud 62 and, because portion 67 is cylindrical, end post 70*a* is in a pivotable relationship with rod 60 about the vertical axis thereof.

Lugs 74 and 74*a* of lower end posts 70 and 70*a* are connected to lower stud 62 in the same manner as upper end posts 70 and 70*a* are connected to upper stud 62, i.e., lug 74 of end post 70 engages retainer 66 in fixed, non-pivotable relationship with vertical rod 60 and lug 74*a* of end post 70*a* is disposed about portion 67 distal to lug 74 of end post 70 and in pivotable relationship with rod 60.

Referring to FIG. 5, upper and lower end posts 70 are connected to studs 62 so that nose portions 72 of upper and lower end posts 70 extend in the same direction perpendicularly outward from the vertical axis of rod 60. In addition, nose portions 72 of upper and lower end posts 70*a* extend perpendicularly outward from the vertical axis of rod 60.

Notably, aperture 75 of end posts 70 and 70*a* is offset relative to the longitudinal axis of nose portion 72, as illustrated in FIG. 7A. The offset of aperture 75 typically is such that the distance between the center of aperture 75 and the longitudinal axis of nose portion 72 is about one-half or slightly greater than one-half of the width of frame members 54, as discussed further below.

Hinge structure 52 comprises caps 90, secured to studs 62 by cap retainer means 68. As shown in top view A FIG. 8, cap 90 preferably has knurled portions 96 on the sides thereof to facilitate attachment and removal and preferably is rounded at the end thereof to facilitate sliding or moving of play structure 50. Cap retainer means 64 may comprise a friction fit nose end or, as shown in FIG. 6, may comprise threads formed in the terminal end of stud 62. Cap 90 is exemplified in cross-section in FIG. 8B with threads 92 formed in hollow interior 94 of cap 90. Cap 90 serves to secure lugs 74 and 74*a* of end posts 70 and 70*a* to studs 62.

Referring again to FIG. 5, upper and lower horizontal frame members 54 are of cylindrical, tubular or beam shape. Each pair of upper and lower frame members 54 is of equivalent length and different pairs of frame members 54 typically are of equivalent length, except for frame members 54 secured to terminal hinging structure 110, which is described below. Each frame member 54 is firmly secured at opposite ends thereof to posts 70 and 70*a* by, e.g., friction fit, conventional snap-fit connection, or glue. Member 54 and end posts 70 and 70*a* can also be constructed as a unitary object, although cost considerations generally dictate a preference for molding and milling member 54 and posts 70 and 70*a* as a separate pieces.

When hinging structure 52 is assembled, lugs 74 of upper and lower posts 70 non-pivotably engage polygonal retainer portion 66 of upper and lower studs 62 of a first vertical rod 60. Posts 70 are secured by nose portion 72 to a first pair of upper and lower horizontal frame members 54. Lugs 74*a* of upper and lower posts 70*a* pivotably engage cylindrical portion 67 of upper and lower studs 62 of first rod 60, with caps 90 secured to rod 60 distally thereto. Posts 70*a* are secured by nose portion 72 to a second, adjacent pair of upper and lower members 54.

The opposite ends of the first pair of frame members 54, are connected by posts 70*a* to studs 62 of a second rod 60, distal to posts 70 of a second adjacent pair of frame members 54, with caps 90 secured distally to studs 62 of second rod 60. The first pair of members 54 is thereby placed in fixed, non-pivotable relationship to first rod 60 and in pivotable relationship to second rod 60. The pivoting movement of a pair of frame members 54 about a rod 60, relative to the non-pivotable relationship of adjacent frame members, allows play structure 50 to be erected into a free-standing structure that can assume a variety of partially enclosed configurations.

Frame members 54 and hinge structure 52 are preferably made of the same material, e.g., a relatively rigid plastic such as acrylonitrile butadiene styrene resin (ABS) or a lightweight metal such as aluminum. However, parts of a play structure 50 can be of different materials if desired, e.g., frame members 54 of metal and hinge structure 52 of plastic.

Play structure 50 further comprises at least one interchangeable panel 100 of canvas, cloth, or thin plastic sheeting that is removably attached to a pair of upper and lower frame members 54. The preferred material for use as panel 100 is flame-retardant polypropylene sheeting, typically abour 10 mils thick. As shown in cross-sectional view in FIG. 11, a strip of hook and loop fastening member 56 is firmly secured by adhesive or other suitable means to the upper surface of lower member 54. A strip of fastening member 56 is similarly secured to the lower surface of upper member 54. Strips of hook and loop fasteners 102 complementary to fasteners 56 are secured at the perimeter of panel 100 on the same side of panel 100. In use, panel 100 is placed next to upper and lower frame members 54, and the upper and lower edges of panel 100 are wrapped around members 54 and the complementary pairs of fasteners 56 and 102 are mated. Panel 100 may be removed by pulling fasteners 56 and 102 apart at both the upper and lower frame members 54. Play structure 50 preferably comprises a plurality of panels 100, each panel preferably of a size sufficient to cover substantially all of the length of frame members 54 to which each panel is attached and of a size sufficient to cover substantially all of the length of vertical rod 60.

Figure 4:
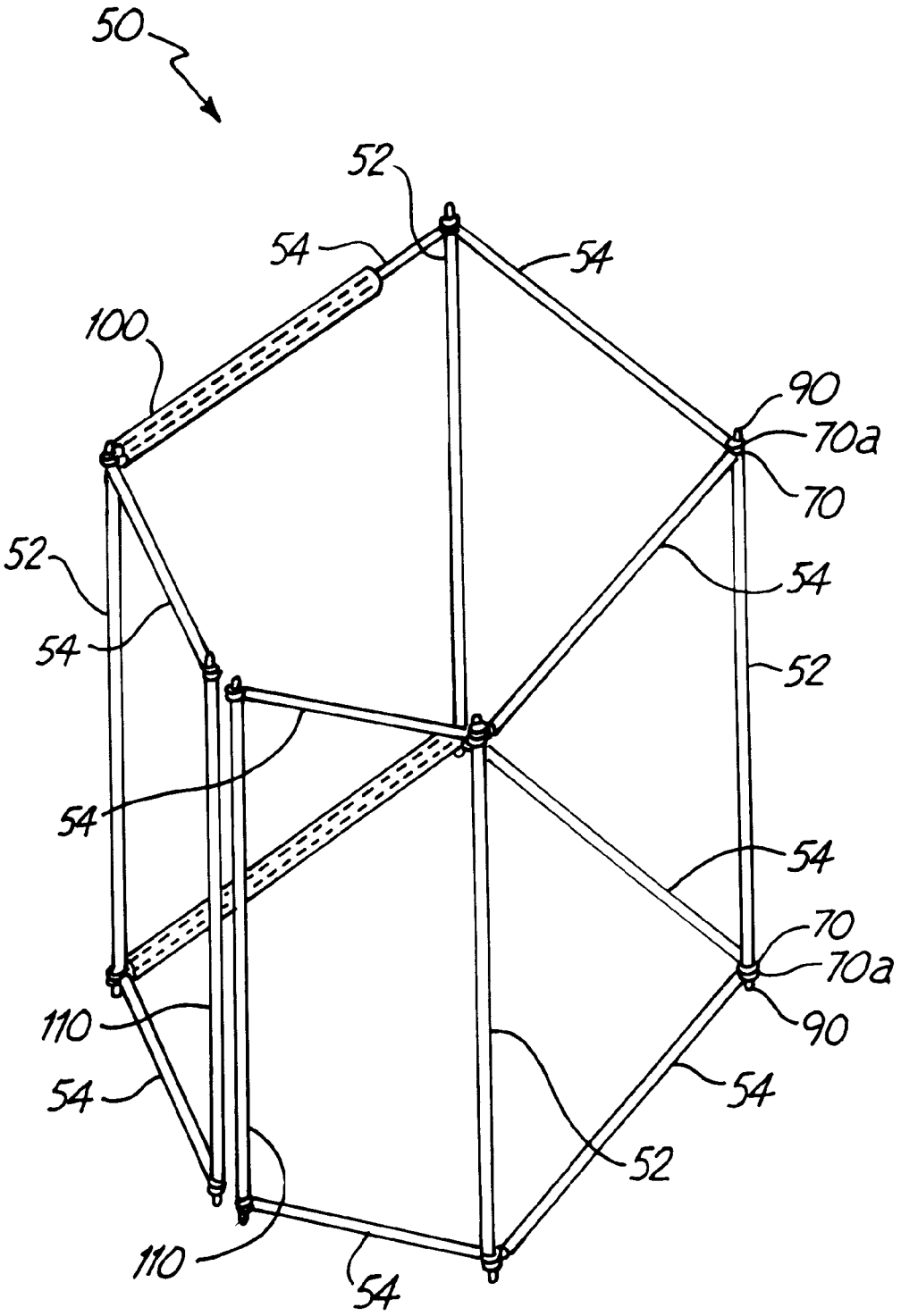
FIG. 4 is a perspective view of a children's play having an open perimeter frame in accordance with a fourth embodiment and showing the play structure in partially closed configuration.
Figure 10:
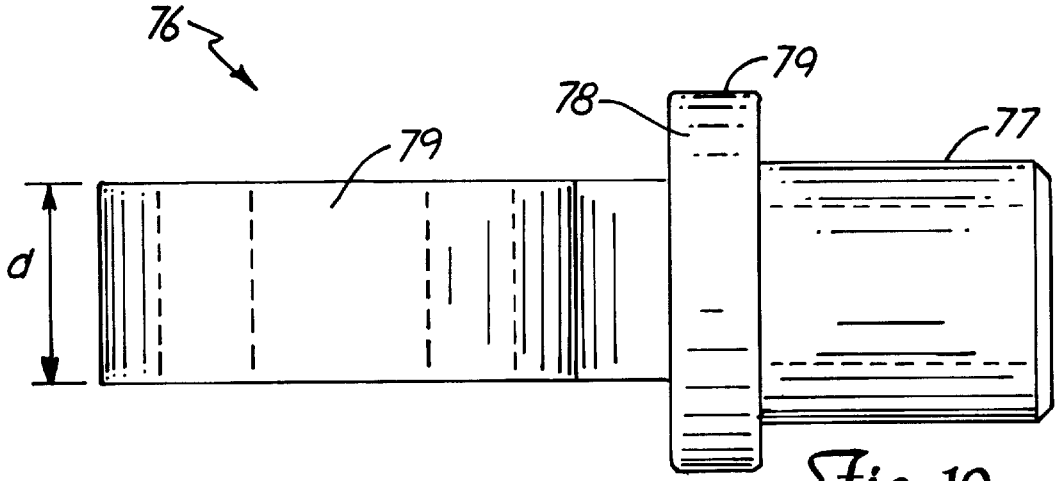
FIG. 10 is a sectional view of a terminal end post of the terminal hinging section of FIG. 9.

Play structure 50 preferably includes a terminal hinge structure 110 at each end thereof, as shown in FIG. 4. Terminal hinge structure 110 is shown in more detail in FIG. 9. Terminal hinge structure 110 is similar to hinge structure 52 except that a single post 76 is connected to each of upper and lower studs 62, rather than two posts 70 and 70*a*. As shown in FIG. 10, terminal post 76 comprises nose portion 77 stop portion 79 and lug 78. Nose portion 77 and stop portion 79 are identical to nose portion 72 and stop portion 73, respectively. Lug 78 comprises a polygonal aperture 79 of the same dimensions as aperture 75. Lug 78 engages a vertical rod 60 of terminal hinge structure 110 in the same manner as lug 74 of post 70, except that lug 78 has a width "d" that is twice that of width "b" of lug 74.

Nose portions 77 of each post 76 are firmly secured to a pair of upper and lower frame members 54 in the same manner as described above for posts 70, thereby placing post 76 and frame members 54 in a fixed, non-pivotable relationship to rod 60 of hinging section 110.

The center of aperture 79 preferably lies along the longitudinal axis of nose portion 77 and is not offset as is aperture 75. However, terminal structure 110 may use a spacer ring (not shown) and an end post 70 connected to stud 62 and to member 54 as described above, rather than end post 76 if desired.

Figure 12:
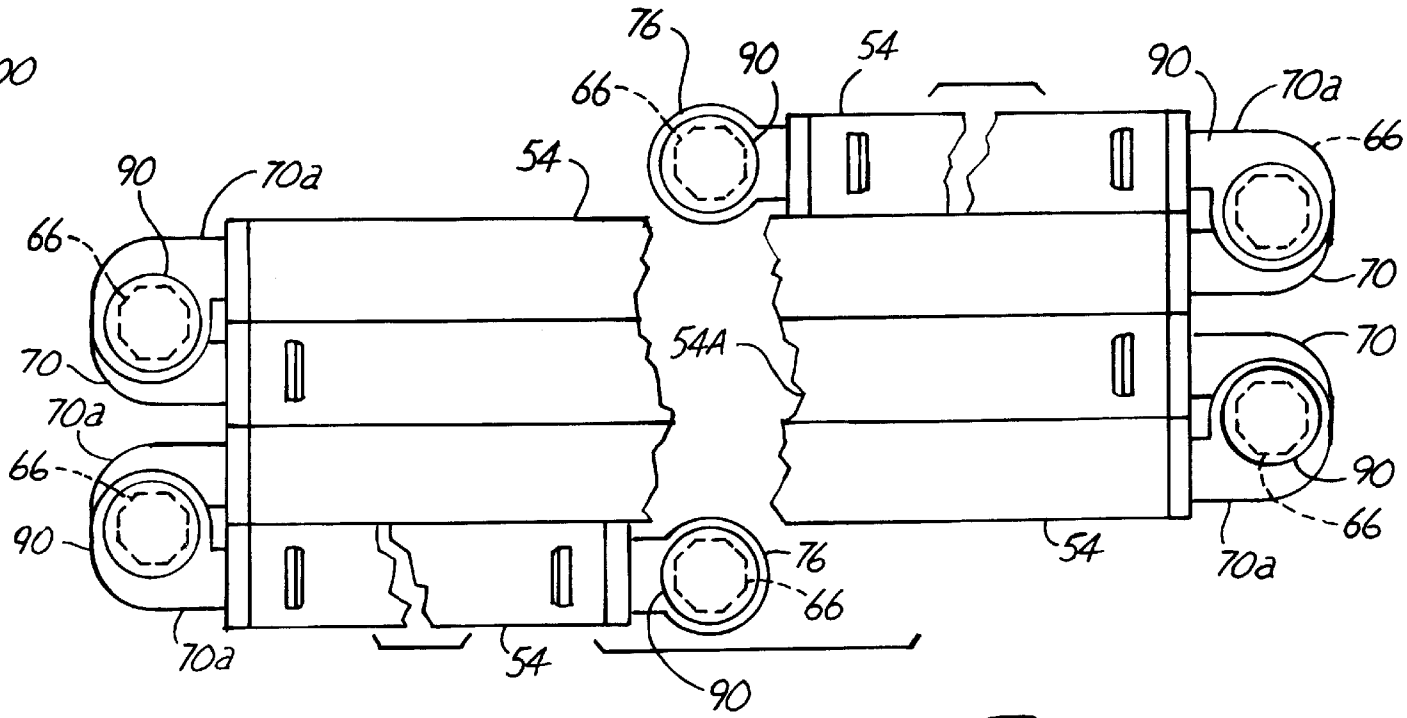
FIG. 12 is a top view of the play structure of FIG. 4, in which all pivotable hinging structures have assumed a folded configuration.

As described above, posts 70 and 70*a* comprise lugs 74 and 74*a*, each having an aperture 75 that is offset from the longitudinal axis of nose portion 72 by a distance that is about one-half or slightly greater than one-half of the width of frame members 54. When two or more hinge structures 52 and three or more pairs of frame members 54 are used to form play structure 50, the offsets of apertures 75 are positioned on alternate sides of the longitudinal axis of members 54, as best seen in FIG. 5B. Positioning the offsets on alternate sides permits frame members 54 of play structure 50 to be disposed immediately adjacent to one another in substantially parallel relationship when structure 50 is completely folded, as best seen in FIG. 12.

Member 54 is shown in FIG. 5A as having lug 74 positioned below the longitudinal axis and lug 74*a* positioned above the longitudinal axis of member 54. However, it will be appreciated that in some frame members 54, both lugs 74 and 74*a* of posts 70 and 70*a* can be positioned above the longitudinal axis of member 54 or below the longitudinal axis of member 54, so long as each hinging structure 52 includes a pivotable and a non-pivotable end post 70 and 70*a* connected to each stud 62 of rod 60. For example, upper frame member 54*a* of FIG. 12 has posts 70 secured at opposite ends thereof, in which both lugs 74 are positioned below the longitudinal axis of member 54*a*.

Figure 13:
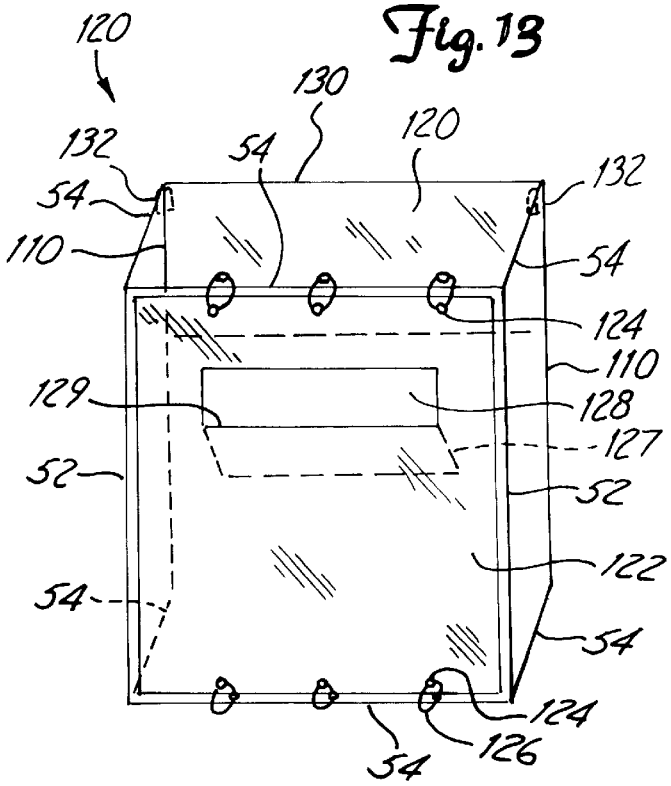
FIG. 13 is a perspective view of a children's play structure having an open perimeter frame and a fourth panel member, with a foldable cutout in one interchangeable panel member.

A fourth embodiment of a children's play structure 120 suitable for use as a children's play theatre is shown in perspective view from the front in FIG. 13. Play structure 120 comprises two hinging structures 52, two terminal hinging structures 110 and three pairs of upper and lower frame members 54. Play structure 120 further comprises planar interchangeable front panel member 122 of a solid, lightweight, durable, resilient material such as doublefaced corrugated high density polyethylene. Front panel member has a plurality of apertures 124 near the upper and lower edges thereof. Panel member 122 is removably secured to front frame members 54 by, for example, a plurality of removable closed loop fastening members 126, each fastening member surrounding either upper or lower frame member 54 and passing through one of apertures 124. Fastening members 126 are of a type similar to fastening members 38, shown in FIG. 2B. Panel member 122 may have a scene or mural painted or printed on the front side thereof.

Panel member 122 also possesses a foldable cutout 127, shown in dotted outline in FIG. 13, formed from three die cut sides of a generally rectangular portion 128 and a generally horizontal notch or incision 129, scored on the bottom side of rectangular portion 128 of panel member 122.

Play structure 120 further comprises a fourth panel 130 of the same material as panel member 122, and approximately the same width as front panel 122. Panel 130 is preferably about one-half the height of panel member 122, as shown by the dotted outline in FIG. 13 and may be, for example, frame sections 12, 14 and 16 (FIG. 1) in a fully open configuration. Panel 130 is removably connected to the upper half of terminal hinging structures 110 by clips 132. Panel 130 preferably includes a scene or mural on the front surface, so that when play structure 120 is in use and cutout 127 is folded down, panel 130 is viewable by a child situated in front of play structure 120. Play structure 120 is of a size suitable for a child to crouch inside the structure below cutout 128, and to present play figures or puppets for viewing through cutout 128, with the scene on panel 130 serving as a background to the play figures.

Figure 11:
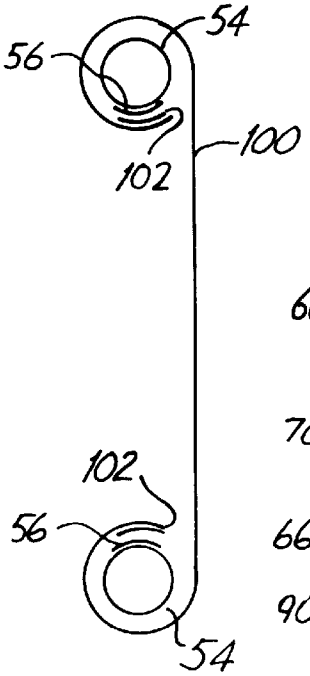
FIG. 11 is a sectional view of upper and lower frame members of one hinging section and associated panel, illustrating the manner in which the panel is removably mounted on the frame members.

Play structure 120 optionally includes two interchangeable panel members 100 (not shown) removably attached on the sides of structure 120 to upper and lower frame members 54 in a manner similar to that shown in FIG. 11.

Figure 14B:
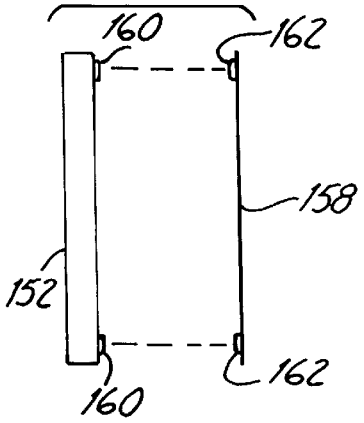
FIG. 14B shows sectional views of a hollow box frame structure.

A fifth embodiment of a children's play structure 150 is shown in FIG. 14. Play structure 150 preferably is of a size to be used as a backdrop for a play figure or doll. Play structure 150 comprises a plurality of hingedly connected hollow box frame sections 152, 154 and 156 of like dimensions, a panel 158 (shown in cross-section in FIG. 14B) of a flexible material having a mural or scene printed or painted thereon and hook and loop fastening members 160 secured to sections 152, 154 and 156 near the upper and lower edges thereof.

Frame box sections 152, 154 and 156 are of a durable material, such as corrugated doublefaced high density polyethylene and have a hollow interior, as best seen in FIG. 14B. When box sections 152, 154 and 156 have a square face about 30 cm on each side, such sections typically have a hollow interior of about 1.2 cm. The material forming box sections 152, 154 and 156 can be about 3 to 4 mm thick. Sections 152, 154 and 156 are pivotably coupled by a plurality of hinges 159 secured on the front side of sections 152, 154 and 156. If desired, sections 152, 154 and 156 may be pivotably coupled by a plurality of hinges 159 secured on both the front and rear sides of the sections.

As shown in FIG. 14B, panel 158 of play structure 150 comprises hook and loop fastening members 162 that are complementary to and removably attach to fastening members 160 of frame box sections 152, 154 and 156.

Figure 14A:
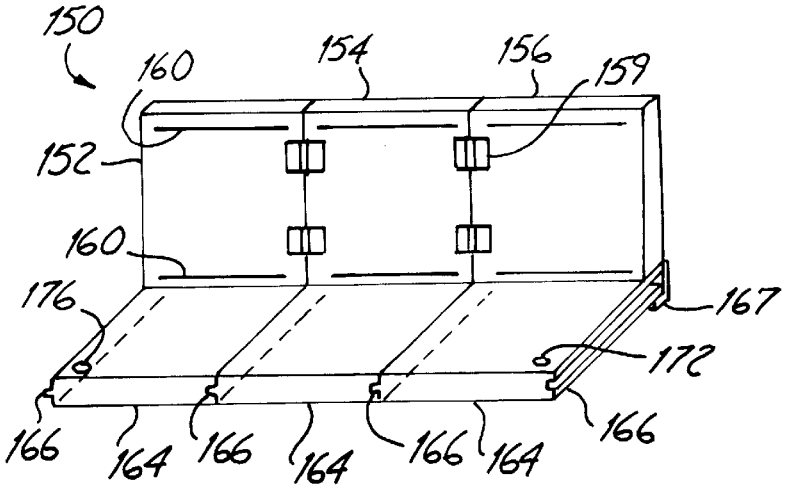
FIG. 14A is a perspective view of a stackable children's play structure having a plurality of hingedly connected hollow box frame structures.

Play structure 150 further comprises one or more hollow box floor sections 164 of a construction similar to that of sections 152, 154 and 156. Floor sections 164 typically have the same dimensions as sections 152, 154 and 156. Side edges 166 of floor sections 164 can be removably connected to each other in a variety of configurations by edge engagement means, e.g., snap-fit connectors or tongue-in-groove configurations in edges 166. The play structure example in FIG. 14 shows a tongue-in-groove configuration. Floor sections 164 also have frame section engagement means on the back edge thereof, e.g., clips 167. Alternatively, mating pairs of hook and loop fasteners may be secured to the upper side of floor section 164 and to the bottom edge of frame sections 152, 154 and 156. Floor sections 164 are coupled to frame sections 152, 154 or 156 perpendicular to the vertical plane of the frame section, as seen in FIG. 14A.

Figure 14C:
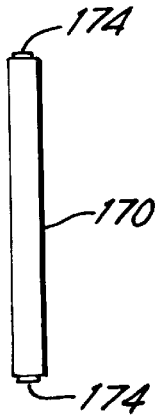
FIG. 14C shows a column for supporting stacked play structures.

Referring to FIG. 14C, play structure 150 optionally comprises a plurality of columns 170 of a cylindrical, oval or beam shape and typically of the same material as that of sections 152, 154 and 156. Columns 170 and sections 152, 154 and 156 are of like height. Columns 170 can be removably connected to floor panels 164 by, for example, complementary pairs of hook and loop fastening members 172 and 174, firmly secured to the top and bottom sides of one or more floor sections 164 and to the ends of columns 170, respectively, as seen in FIGS. 14A and 14B. Alternatively, one or more floor sections 164 may have a depressions 176 routed in both sides of a corner thereof, depression 176 being of a size suitable for receiving the end of column 170. One floor section 164 in FIG. 14A is shown with depressions 176.

Figure 15A:
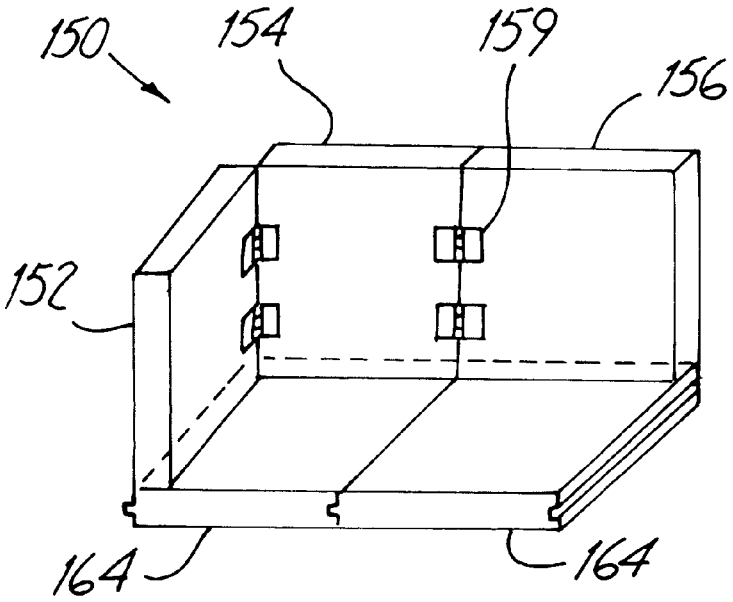
FIG. 15A shows a perspective views of the children's play structure of FIG. 14 in L configuration.
Figure 15B:
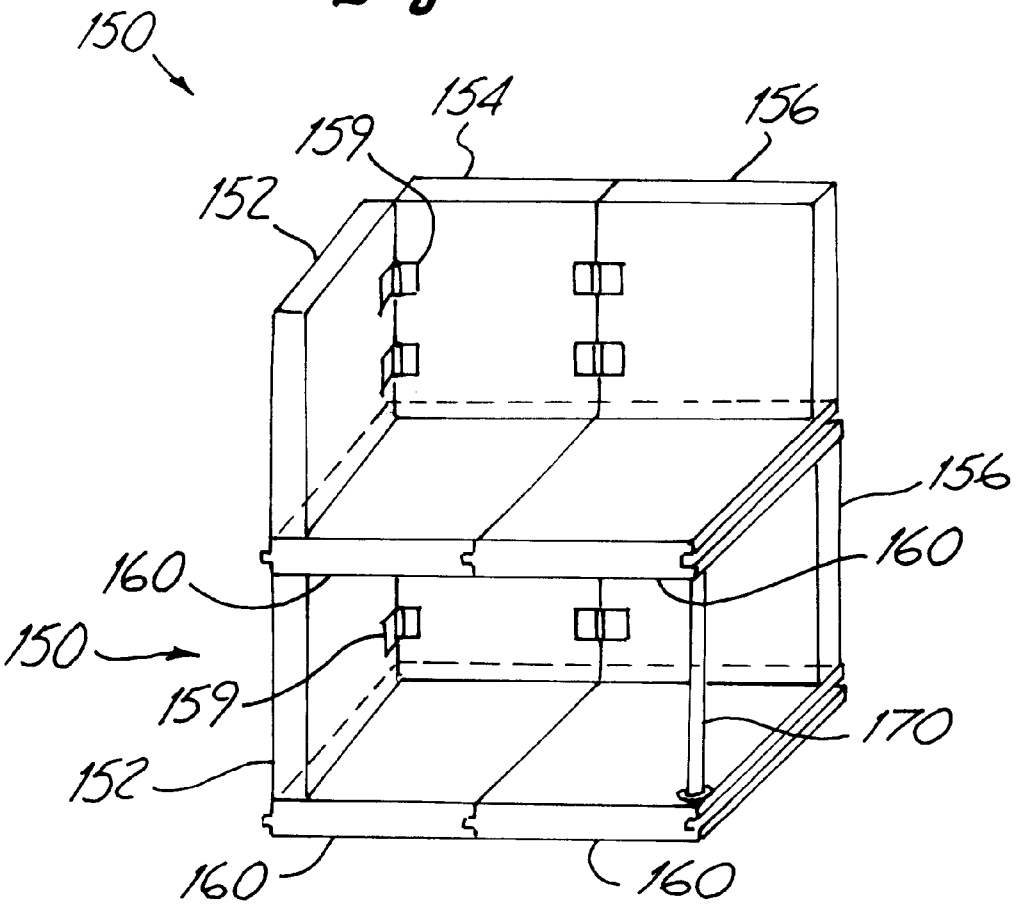
FIG. 15B shows two children's play structures in stacked configuration.

As shown in FIGS. 15A and 15B, play structure 150 may be erected into a variety of free-standing configurations, including L-shapes. A plurality of structures 150 can stacked to form multi-level configurations when optional column 170 is used.

To the extent not already indicated, it will be understood by those of ordinary skill in the art that any one of the various specific embodiments herein described and illustrated may be further modified to incorporate features shown in other of the specific embodiments.

The foregoing detailed description has been provided for a better understanding of the invention only and no unnecessary limitation should be understood therefrom as some modifications will be apparent to those skilled in the art without deviating from the spirit and scope of the appended claims.

What is claimed is:

1. A children's play structure, comprising:

a) a plurality of hinging structures comprising at least first and second hinging structures, each said hinging structure comprising:

i) a vertical rod having upper and lower studs extending from opposite ends of said rod, each said stud having a polygonal portion and a cylindrical portion of narrower width distal to said polygonal portion;

ii) a pair of first and second end posts removably attached to said upper stud and a pair of first and second end posts removably attached to said lower stud, said end posts having a lug with a polygonal aperture offset from the longitudinal axis of a nose portion of said end posts, said apertures of said first end posts non-pivotably engaging said polygonal portion of said studs and said apertures of said second end posts pivotably disposed about said cylindrical portion of said studs; and iii) a pair of caps removably attached to each of said upper and lower studs of said rod, distal to said second end posts;

b) a plurality of upper and lower frame members comprising at least:

i) a pair of first upper and lower frame members secured at one end thereof to either said first or said second end posts of said first hinging structure and secured at the opposite end thereof to either said first or said second end posts of said second hinging structure;

ii) a pair of second upper and lower frame members secured to the other of said end posts of said first hinging structure; and iii) a pair of third upper and lower frame members secured to the other of said end posts of said second hinging structure;

c) first and second terminal hinging structures, each said terminal hinging structure comprising:

i) a vertical rod having upper and lower studs extending from opposite ends of said rod, each said stud having a polygonal portion and a cylindrical portion of narrower width distal to said polygonal portion; and ii) an end post removably attached to each of said upper and lower studs, said end posts having a lug with a polygonal aperture therein, said apertures non-pivotably disposed about said polygonal portion of said studs, said first terminal hinging structure end posts secured to said second upper and lower frame members and said second terminal hinging structure end posts secured to a pair of upper and lower frame member other than said first and second upper and lower frame members;

d) at least one interchangeable panel member removably attached to said first or said second upper and lower frame members; and e) engagement means for removable attachment of said interchangeable panel member to said first or said second upper and lower frame members.

2. The play structure of claim 1, wherein said interchangeable panel member is comprised of a flexible material.

3. The play structure of claim 2, said play structure further comprising a plurality of said interchangeable panel members, each of said panel members removably attached to a different one of said upper and lower frame members.

4. The play structure of claim 1, wherein:

a) said at least one interchangeable panel member comprises a solid, lightweight, durable, resilient, substantially planar member, said member having a plurality of openings near upper and lower peripheral edges thereof; and b) said engagement means comprises a plurality of removable closed loop fastening members, said fastening members surrounding one of said upper frame members and passing through one of said upper panel openings or surrounding one of said lower frame members and passing through one of said lower panel openings.

5. The play structure of claim 4, wherein:

a) said play structure further comprises a rear panel of a solid, lightweight, durable, resilient, substantially planar material having the same width as said interchangeable panel member, said rear panel being removably connected at side edges thereof to said terminal hinging structures; and b) said interchangeable panel member further comprises a foldable cutout.

* * * * *